United States Patent [19]

Bertina

[11] Patent Number: 4,563,550

[45] Date of Patent: Jan. 7, 1986

[54] KEYBOARD HAVING LOW PROFILE MODULAR KEYS

[75] Inventor: Domenico Bertina, Parella, Italy

[73] Assignee: Ing. C. Olivetti & C., S.p.A., Turin, Italy

[21] Appl. No.: 435,652

[22] Filed: Oct. 21, 1982

[30] Foreign Application Priority Data

Oct. 21, 1981 [IT] Italy ..... 68360 A/81

[51] Int. Cl.[4] ..... H01H 13/70

[52] U.S. Cl. ..... 200/5 A; 200/153 J; 200/159 B; 200/314; 200/340

[58] Field of Search ..... 200/5 A, 5 R, 153 J, 200/153 JH, 159 B, 314, 340

[56] References Cited

U.S. PATENT DOCUMENTS

| | | | |
|---|---|---|---|
| 3,663,780 | 5/1972 | Golbeck | 200/314 |
| 3,770,923 | 11/1973 | Habecker | 200/153 J |
| 4,096,368 | 6/1978 | Grebner | 200/153 J X |
| 4,367,383 | 1/1983 | Sommansson | 200/153 J |

FOREIGN PATENT DOCUMENTS

| | | | |
|---|---|---|---|
| 1367668 | 6/1964 | France | 200/153 JH |

*Primary Examiner*—J. R. Scott

*Attorney, Agent, or Firm*—Banner, Birch, McKie & Beckett

[57] ABSTRACT

A contact keyboard comprising a plurality of modular keys individually insertable in a base frame having feet adjustable in height in order to permit a variable inclination of the key plane. The majority of the keys are of the dash actuation type, in which an actuator resiliently deforms a metallic lamina urging it from a stable configuration with opened contacts to an unstable configuration in which an electric contact is established between two parts of an electrical circuit. A group of keys is of the bistable type, in which a cam allows the actuator to stably position itself in one of two possible closed/open positions and in which the actuation is signalled by the illumination of a lamp inside the key.

7 Claims, 14 Drawing Figures

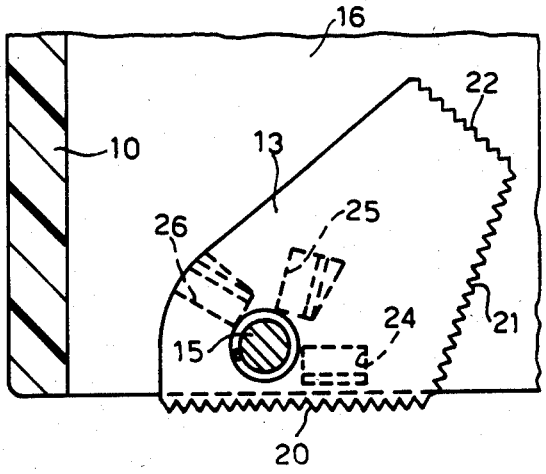
FIG.4
FIG.5
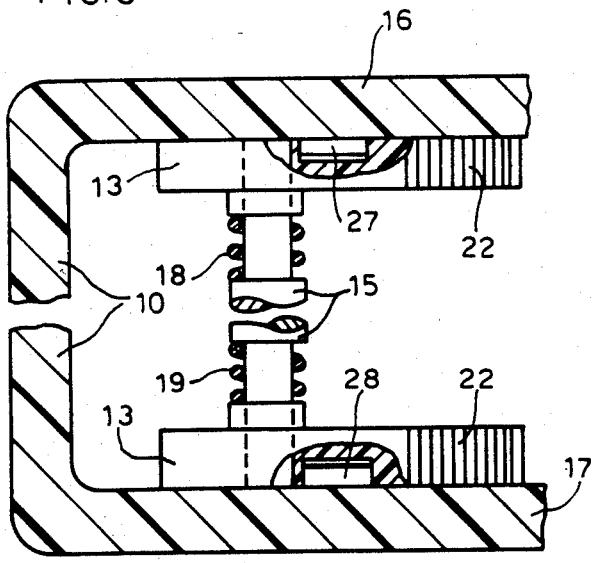

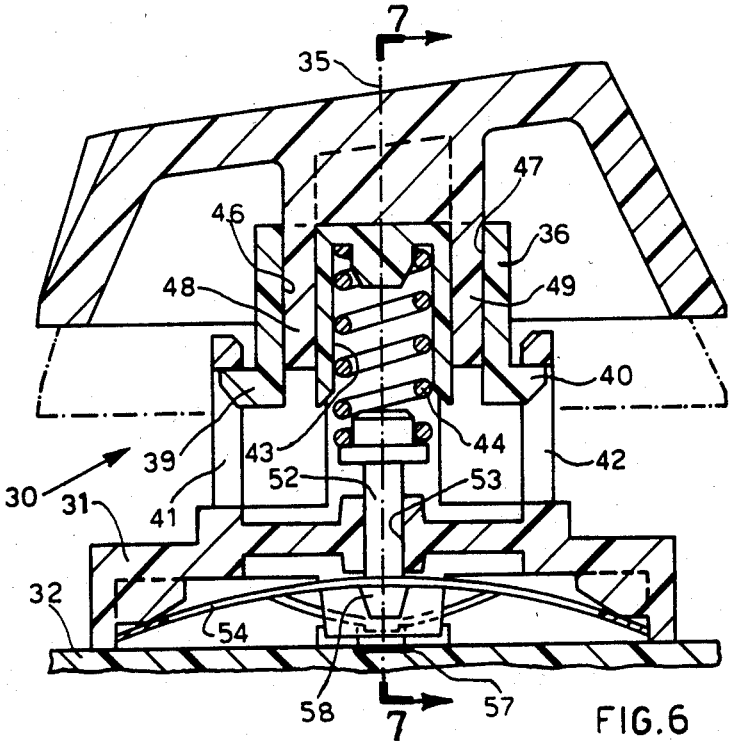
FIG.6
FIG.7
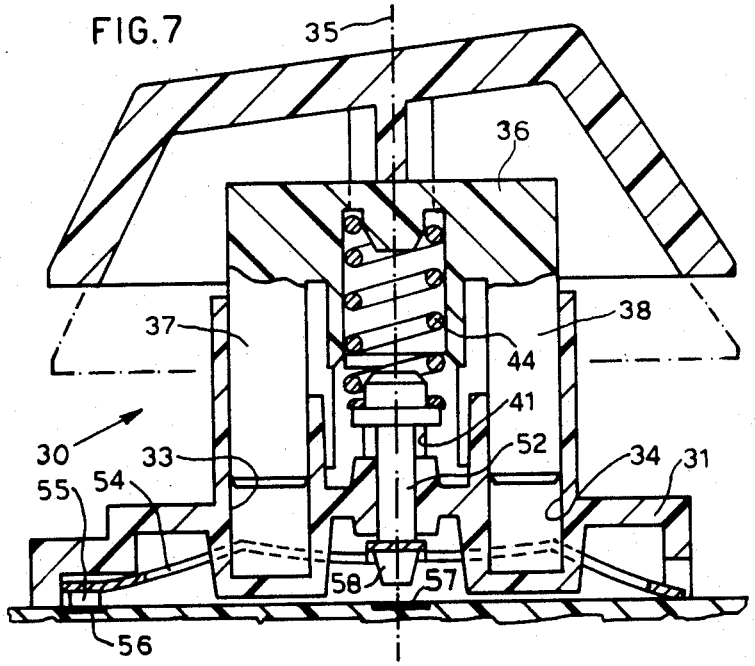

KEYBOARD HAVING LOW PROFILE MODULAR KEYS

BACKGROUND OF THE INVENTION

1. Field of the Invention

The present invention refers to a contact keyboard comprising a plurality of modular keys, individually insertable into a base frame, and in which each key comprises an actuator, axially movable for establishing connection between two parts of an electrical circuit, and an indicator cap mounted on the actuatable portion of the actuator.

2. Description of the Prior Art

In some known keyboards the connection between the parts of the electrical circuit is made by a conductive lamina which is deformable from a stable configuration with open contacts into an unstable configuration with closed contacts.

Upon depression of a key, the movable actuator performs a predetermined stroke, at the end of which the conductive lamina deforms from its stable to its unstable configuration due to the load of the actuator which overcomes the elastic reaction of the lamina itself. The extent of the deformation of the lamina is usually several millimetres while the total height of the key, owing to the dimensions of the cap, the actuator and the slides needed for a reliable actuation, results of the order of several centimeters, which is excessive for some particular uses of the keyboard.

SUMMARY OF THE INVENTION

A first object of the present invention is that of providing a keyboard in which the total height of the keys is greatly reduced, while the stroke of the single actuators remains unchanged, so as to obtain a resulting "low profile" keybord maintaining its characteristics of simplicity, reliability, and economy.

Pursuant to the first object, the keyboard according to the invention is characterized in that each movable actuator is provided with vertical slides diametrically opposite with respect to a sliding central axis of the actuator, and in that a pair of housings suitable to receive the stems of the cap, are formed in the actuator on opposite sides with respect to its central axis and displaced by 90° with respect to the vertical slides.

A second object of the present invention is that of providing a keyboard having some bistable and optionally illuminated keys which are reliable, simple and economical.

Pursuant to the second object the keyboard in accordance with the invention is characterized in that the actuator is provided with a cam-follower bound to move perpendicularly with respect to the actuator's stroke and in that the cam follower is partially lodged in a groove of an element which is fixed to the key and embodies the bistability function of the key.

A third object of the present invention is that of providing a keyboard in which the inclination of the key plane with respect to the support plane may be varied by predetermined angles in a simple manner.

Pursuant to the third object, the keyboard according to the invention is characterized by a pair of feet pivoting upon the base plate and having a plurality of resting surfaces, the surfaces having different distances from the corresponding pivots.

The foregoing and other characteristics of the invention will be clear from the following description of a preferred embodiment, made by way of example and not of limitation, with the aid of the annexed drawing:

BRIEF DESCRIPTION OF THE DRAWING

FIG. 4 is a partially sectioned side view of some enlarged details of the keyboard according to the invention;

FIG. 5 is a partially sectioned plane view of the details of FIG. 4;

FIG. 6 is a sectioned side view of a first key of the keyboard according to the invention;

FIG. 7 is a section along the line 7—7 of FIG. 6;

DESCRIPTION OF THE PREFERRED EMBODIMENTS

Figure 1:
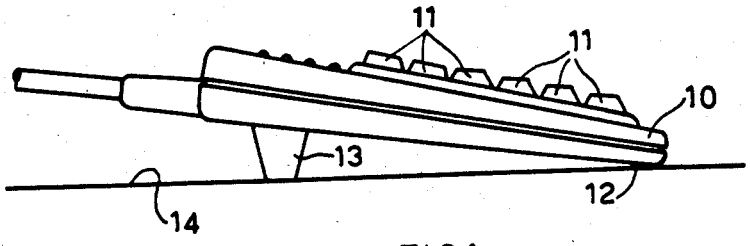
FIG. 1 is a side view of a keyboard in accordance with the invention in a first working position.
Figure 2:
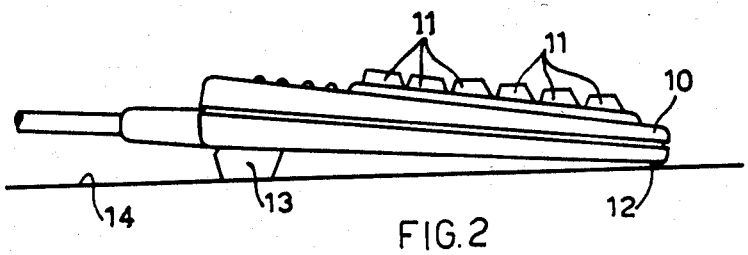
FIG. 2 is a side view of a keyboard in accordance with the invention in a second working position.
Figure 3:
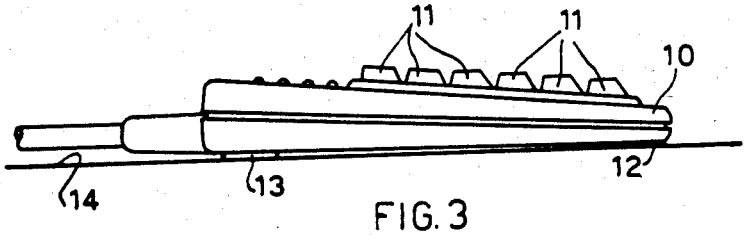
FIG. 3 is a side view of a keyboard in accordance with the invention in a third working position.

With reference to FIG. 1, the keyboard in accordance with the invention comprises a rigid frame 10, having a substantially parallelepiped shape, in which a plurality of keys 11, hereinafter described in detail, are mounted.

The frame 10 is provided underneath with support feet 12 and 13 by means of which it may stand on the plane 14.

According to a characteristic of the present invention the fore feet 12 are fixed, whilst the back feet 13 may jut out more or less from the bottom of the frame 10, so that the inclination of the key plane 11 with respect to the support plane 14 is variable at the option of the user.

In particular the feet 13 (FIGS. 4 and 5) are rotatably mounted on a shaft 15 fixed to the lateral sides 16 and 17 of the frame 10. Each foot 13 is shaped so as to have shagreened surfaces 20, 21 and 22, which are differently spaced from the shaft 15, and is provided with positioning notches 24,25 and 26 equally spaced from the shaft 15.

Two positioning teeth 27 and 28 are fixed to the sides 16 and 17 and are suitable to cooperate with the notches 24,25 and 26 of the feet 13.

Two helicoidal springs 18 and 19, which are coaxial with the shaft 15, urge the feet 13 against the inside walls of the corresponding sides 16 and 17 and hold the teeth 27 and 28 inside one of the notches 24, 25 or 26. The keys 11 of the keyboard according to the invention are of two types: monostable and "low" or bistable and "illuminated".

Each "low" key 30 (FIGS. 6 and 7) comprises a body 31 having a substantially rectangular section and is suitable to be removably mounted on a base plate 32. The body 31 is shaped so as to have two cylindrical slides 33 and 34 positioned on opposite sides with respect to a central axis 35 (FIG. 7).

An actuator 36 is slidable along the axis 35 and has two side cylinders 37 and 38 lodged inside the cylindrical slides 33 and 34. The actuator 36 is provided with two side wings 39 and 40 which are lodged into two grooves 41 and 42 of the body 31 and are positioned at 90° with respect to the side cylinders 37 and 38.

The actuator 36 is also provided with a central hollow 43 inside which a helicoidal spring 44 is lodged. Between the central hollow 43 and the side wings 39 and 40, two through holes 46 and 47 are provided, in which the lower stems 48 and 49 of a cap 50 are fitted in a forced manner; the cap 50, with its specific indication, is easily assemblable with the generic actuator 36. The cap 50 is internally hollow so as to receive the upper portion of the actuator 36.

A striker 52, substantially cylindrically shaped is slidable along the central axis 35 inside a hole 53 of the body 31 and has its upper portion cooperating with the helicoidal spring 44.

The lower portion of the striker 52 cooperates with a spring 54, dome-shaped in its stable state and of known type, for instance as described in the U.S. Pat. No. 4,200,778, issued on Apr. 29, 1980.

The spring 54 is metallic and has one of its ends in continuous contact with the conductive area 56 of a printed circuit formed on the base plate 32. A metallic tablet 58 of the spring 54 is suitable to contact the conductive area 57 of the same printed circuit in order to close a contact, so generating in a known manner, a corresponding electrical signal, when the actuator 36 of the key is depressed by acting on the cap 50. The actuator 36 has a maximum stroke of about 4 mm., which is a stroke-value common to all the keys for contact keyboards.

Figure 8:
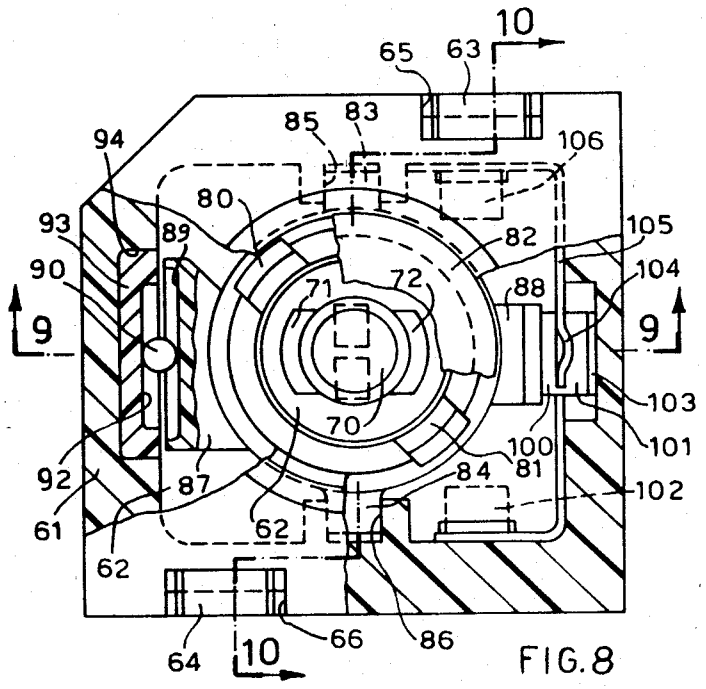
FIG. 8 is a partially sectioned plane view of a second key of the keyboard in accordance with the invention.
Figure 10:
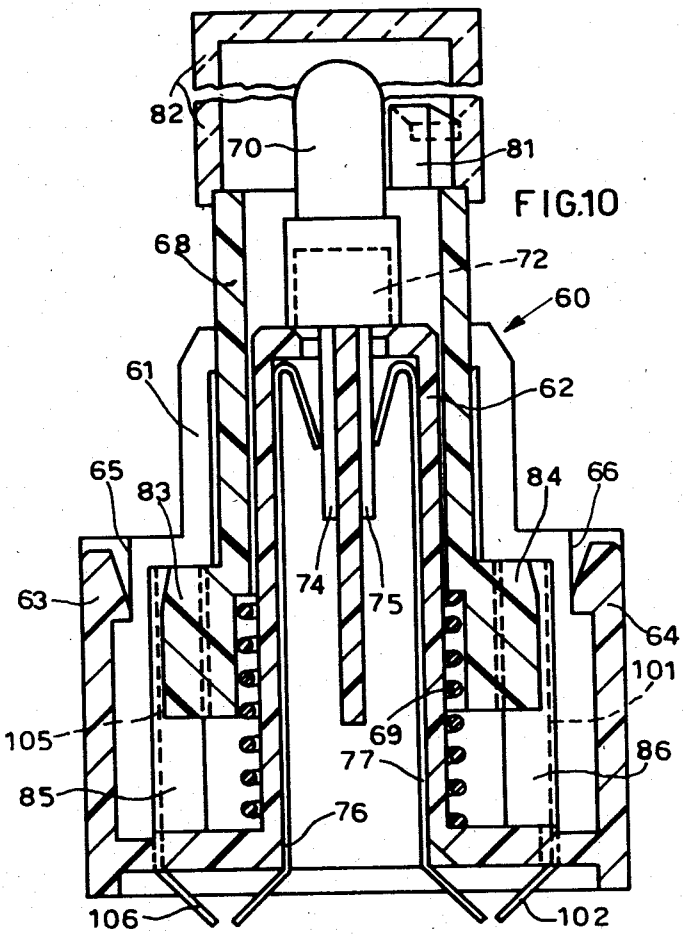
FIG. 10 is a section along the line 10—10 of FIG. 8.
Figure 9:
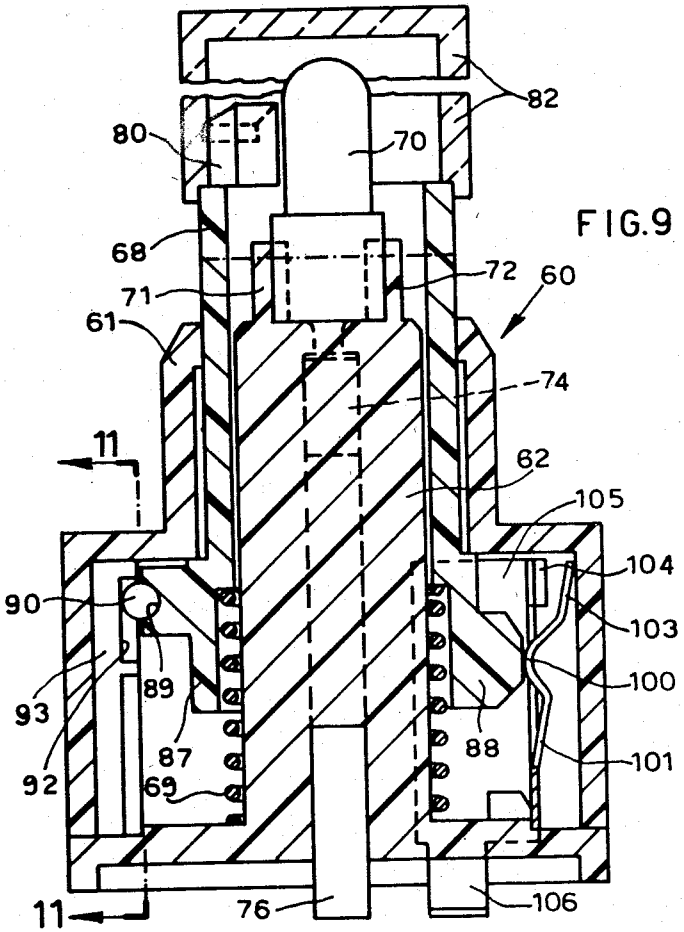
FIG. 9 is a section along the line 9—9 of FIG. 8.

The whole key 30, including the cap 50, has a total height of about 20 mm., which renders it very low and suitable to permit the embodiment of a very flat keyboard of the "low profile" type. This characteristic is due to the fact that the cap 50 lodges on its inside a portion of the active elements of the key, such as the actuator 36 and, when depressed, a portion of the cylindrical slides 33 and 34 of the fixed body 31. An illuminated and bistable key 60 (FIGS. 8, 9 and 10) comprises an external body 61 having a substantially parallelepiped-shaped lower portion of square section, which is hollow and bottomless, and an upper cylindrical-shaped portion.

A lamp-holding element 62 is lodged inside the body 61 and comprises a cylindrical central portion, hollow in its inside, and a base lower portion of squared section which constitutes the bottom of the body 61. A lamp 70 is mounted between the jaws 71 and 72 of the element 62 and includes two electrical terminals 74 and 75 contacting the upper ends of two conductive laminae 76 and 77 lodged inside the element 62 and suitable to be connected, in a known manner, to the electrical circuit portion of the keyboard (not shown in the drawings) so that the lamp 70 may be selectively illuminated.

A substantially cylindrical-shaped slider 68, hollow in its inside, is slidably mounted between the body 81 and the cylindrical upper portion of the lamp-holding element 62. A helicoidal spring 69 is mounted coaxially to the element 62 and continuously urges the slider 68 upwardly.

A cap 82 made by transparent material, is mounted on the upper end of the slider 68 and hinged to two teeth 80 and 81.

The slider 68 is provided in its lower portion with two lateral, vertical and diametrically opposite appendices 83 and 84 (FIG. 8) guided in corresponding inside grooves 85 and 86 of the body 61. Further, the slider 68 is shaped so as to have two cantilevered elements 87 and 88 diametrically opposite each other and displaced 90° with respect to the side appendices 83 and 84.

A horizontal slide 89 is provided in the element 87, inside of which a sphere 90 is free to slide. Said sphere 90 is partially lodged in a groove 42 (FIG. 11) obtained on a plate 93, which is fitted in a nook 94 of a lateral side of the body 61.

Figure 11:
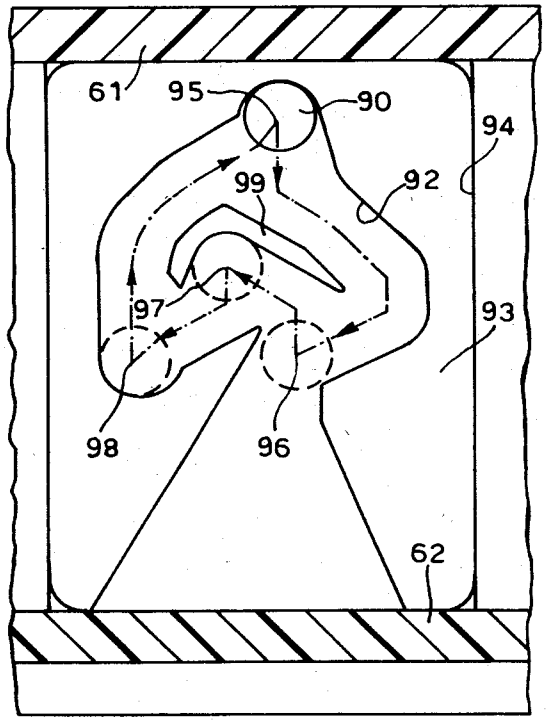
FIG. 11 is a section along the line 11—11 of FIG. 9 according to an enlarged scale.

The groove 92, as is clearly shown in FIG. 11, owing to the position of a retaining wall 99, defines a forced path for the sphere 90. Said path, which is indicated by a dash-dotted line in FIG. 11, is substantially circular and unidirectional and has deadlocks 95,96,97 and 98 which identify positions in which the sphere 90 reverses the vertical direction of its motion, as better described hereinafter.

The element 88 (FIGS. 8 and 9) continuously cooperates with a folding 100 of a metallic, flexible lamina 101 which is shaped so as to have a lower end 102 which juts out from the lower portion of the element 62, and an upper end 103 suitable to selectively contact an end of a metallic lamina 105.

Also the metallic lamina 105 has the lower end 105 jutting out from the lower portion of the element 62. The two ends 102 and 106 are suitable to be connected, in a known manner, to the electrical circuit part of the keyboard, not shown in the drawings.

The operation of the illuminated and bistable key 60 is as follows.

In a first stability condition the key 60 has the slider 68 urged upwardly by the spring 69. In this position the element 88 holds the upper end 103 of the lamina 101 disconnected from the end 104 of the lamina 105. Further in said condition the lamp 70 may be switched on or off, independently from the position of the slider 68, or it might be associated to the slider 68 and be switched off when the slider 68 is lowered. When the slider 68 is pushed downwards, against the action of the spring 69, the sphere 90 inside the groove 92 (FIG. 11) moves along the forced path until it reaches the lower deadlock 96. When the sphere 90 has reached this position, the slider 68 cannot be lowered any further, since its lower end contacts the bottom of the element 62.

Upon release, the slider 68, always urged by the spring 69, returns upwards until it comes to rest when the sphere 90 reaches the intermediate deadlock 97.

In this second condition of stability, the key 60 has the slider 68 partially lowered, with the element 88 no longer cooperating with the portion 100 of the flexible lamina 101; therefore the two ends 103 and 104 of the laminae 101 and 105 are in contact and a corresponding electrical signal may be generated, in a known manner, by the electrical circuit part of the keyboard.

In order to return the key 60 to the first stability condition, the slider 68 is lowered again until the sphere 90, by continuing in its circular and unidirectional motion along the forced path inside the groove 92, reaches the second lower deadlock 98.

The slider 68 is now released in order that the sphere 90 may bring it back to its initial position, i.e. with the sphere 90 positioned in the upper deadlock 95.

Figure 13:
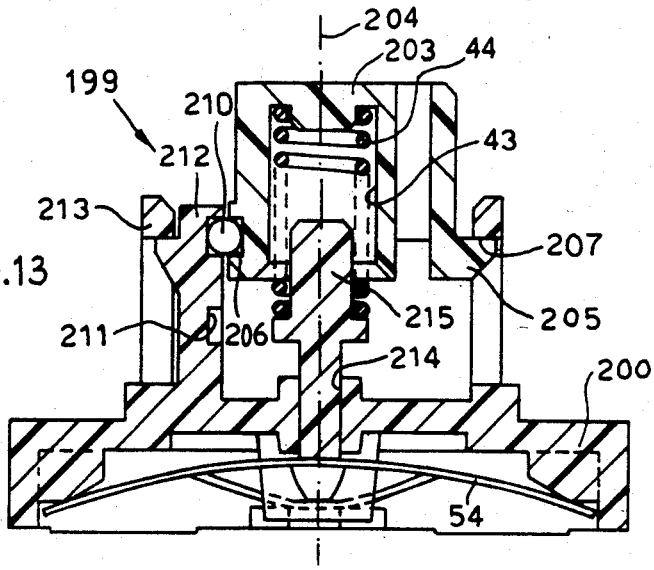
FIG. 13 is a section along the line 13—13 of FIG. 12.
Figure 12:
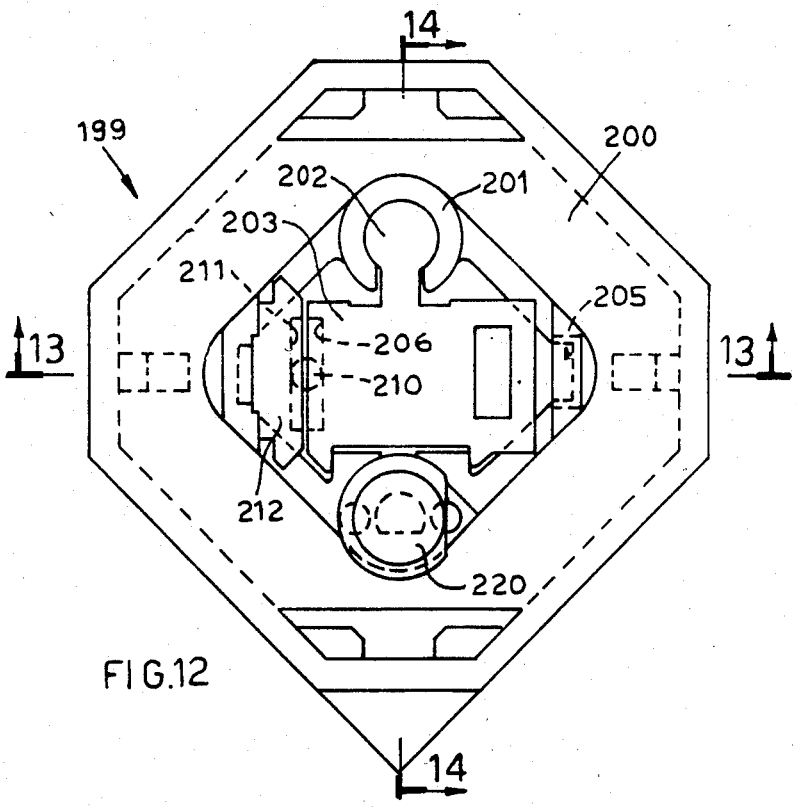
FIG. 12 is a plane view of a third key of the keyboard in accordance with the invention.
Figure 14:
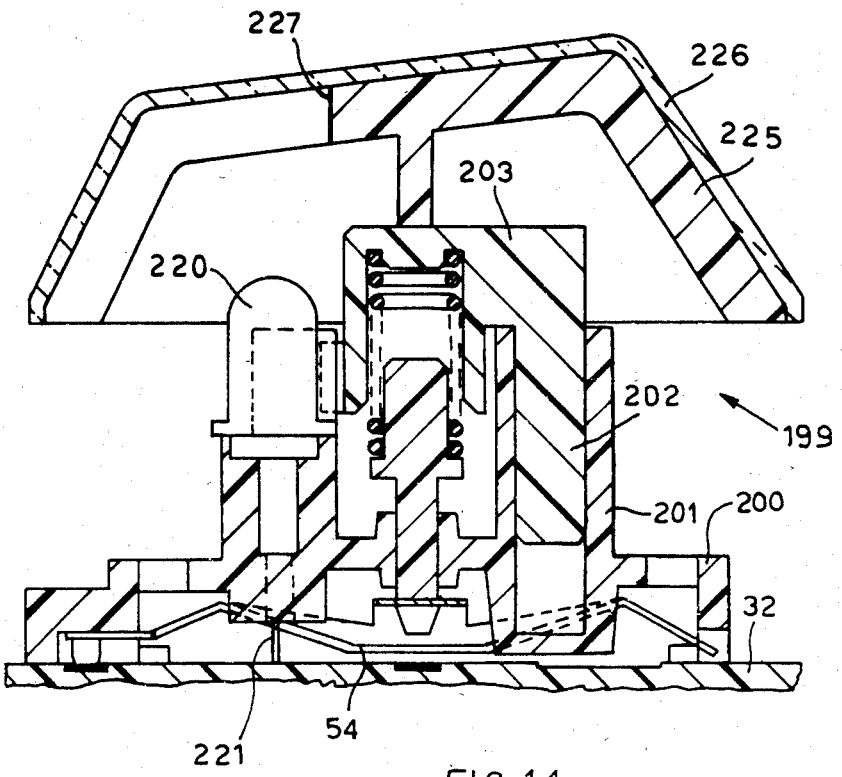
FIG. 14 is a section along the line 14—14 of FIG. 12.

In FIGS. 12, 13 and 14 a third type of key 199 of the keyboard is represented in accordance with the present invention.

This key 199 comprise a body 200 having a substantially rectangular section and which is suitable to be removably mounted on the base plate 32. The body 200 has a vertical cylindrical slide 201, on which is lodged a cylinder 202 of an actuator 203, which is slidable along an axis 204. The actuator 203 is provided with a side wing 205 which is lodged in a groove 207 of the body 200 and is positioned at 90° with respect to the cylinder 202.

The actuator 203 is also provided with a horizontal slide 206, perpendicular to the axis 204, inside which a sphere 210 is free to slide. The sphere 210 is also partially lodged in a groove 211 obtained in a plate 212 which is mounted on a lateral side 213 of the body 200. The actuator 203, as the actuator 36, is also provided with a central hollow 43 inside which a helicoidal spring 44 is lodged. A striker 215 is slidable along the central axis 204 inside a hole 214 of the body 200 and has its upper portion cooperating with the spring 44. The lower portion of the striker 215 cooperates with a spring 54, dome-shaped.

The groove 211 is similar to the groove 92 clearly shown in FIG. 11, and permits to the actuator 203 to stop in two different stable positions, as the actuator 68 of the key described hereinbefore.

Moreover the key 199 comprises a light emitter diode (LED) 220 which is mounted on the body 200 at the opposite side of the cylindrical slide 201 with respect to the axis 204. The LED 220 has two lower terminals 221 connected in a known manner to the electric circuit of the base plate 32.

The LED 220, like the lamp 70, may be switched on or off independently from the position of the actuator 203. A cup 225, mounted on the actuator 203, has a transparent cover 226, and is provided with an aperture 227 through which the light emitted by LED 220 is visible by the operator.

In this manner the key 199 is "low", bistable and "illuminated".

Obviously, additions and modifications may be made to the contact keyboard described above, without departing from the scope and the spirit of the present invention. For instance, as an alternative to the sphere 90, another cam-following element of the oscillating type might be used, which might be hinged to the slider 68 by a shaft and might cooperate with the groove 92, so as to move perpendicularly with respect to the sliding direction of the slider 68.

What I claim is:

1. In a keyboard comprising a base frame, electrical circuit means mounted on said base frame and actuatable for generating electrical signals, and a plurality of modular keys individually mounted on said base frame for selectively actuating said electrical circuit means, the improvement wherein each one of said modular keys comprises:

a body having a central longitudinal axis perpendiculr to said base frame and provided with two cylindrical slides perpendicular to said base frame and disposed at diametrically opposite sides with respect to said central longitudnal axis, and with two grooves perpendicular to said base frame and disposed at diametrically opposite sides with respect to said central longitudinal axis in intermediate positions between said two cylindical slides, an actuator member having two cylindrical elements lodged inside said cylindrical slides of said body for sliding parallel to said central longitudinal axis towards and away from said electrical circuit means, two stop elements cooperating with said two grooves, and at least a longitudinal slot parallel to said cylindrical elements, spring means interposed between said base frame and said actuator element for normally urging said actuator element away from said electrical circuit means, and a cap having means insertable into said longitudinal slot of said actuator member and comprising a hollow portion in which said actuator member and said body are partially lodged.

2. A keyboard according to claim 1, wherein said spring means comprises an elastically deformable lamina contacting said electrical circuit means and a helicoidal spring contacting said actuator member, wherein a striker element is interposed between said deformable lamina and said helicoidal spring, and wherein said body comprises a central guide for guiding said striker element along said central longitudinal axis towards and away from said electrical circuit means.

3. A keyboard according to claim 2 wherein said actuator member comprises a central hollow for lodging said helical spring.

4. In a keyboard comprising a base frame, electrical circuit means mounted on said base frame and actuatable for generating electrical signals, and a plurality of modular keys individually mounted on said base frame for selectively actuating said electrical circuit means, the improvement wherein each one of said modular keys comprises:

a body having a lower base portion parallel to said base frame, a central longitudinal axis perpendicular to said base frame, an upper portion having a substantially rectangular cross section so defining four corners substantially equidistant from said central longitudinal axis, a cylindrical longitudinal slide provided on a first corner of said upper portion, lamp supporting means provided on a second corner of said upper portion diametrically opposite to said first corner, a longitudinal groove provided on a third corner of said upper portion, and cam means provided on a fourth corner of said upper portion, an actuator member having a cylindrical element lodged inside said cylindrical longitudinal slide for sliding parallel to said central longitudinal axis towards and away from said electrical circuit means, a stop element cooperating with said longitudinal groove, and a cam follower means cooperating with said cam means, and spring means interposed between said base frame and said actuator element for normally urging said actuator element away from said electrical circuit means.

5. A keyboard according to claim 4, wherein said spring means comprises an elastically deformable lamina disposed inside said base portion of said body and contacting said electrical circuit means, and a helicoidal spring contacting said actuator member, and wherein a striker element is interposed between said deformable lamina and said helicoidal spring.

6. A keyboard according to claim 4, wherein said cam means comprises a shaped groove defining a substantially forced unidirectional closed path for said cam follower means comprising at least two deadlocks corresponding to two stability positions of said actuator member, and wherein said cam follower means comprises a sphere lodged in a transversal groove provided in said actuator member.

7. A keyboard according to claim 4, wherein for each of one of said modular keys a cap is provided, each cap having means connectable with said actuator member and being provided with a hollow portion in which said actuator member and said body are partially lodged.

* * * * *